US005992197A

United States Patent [19]

Freeman et al.

[11] Patent Number: 5,992,197

[45] Date of Patent: Nov. 30, 1999

[54] FORMING TECHNIQUE USING DISCRETE HEATING ZONES

[75] Inventors: Richard B. Freeman, Oxford; Mark C. Handley, Beverly Hills, both of Mich.

[73] Assignee: The Budd Company, Troy, Mich.

[21] Appl. No.: 08/828,405

[22] Filed: Mar. 28, 1997

[51] Int. Cl.[6] ..... B21D 9/18

[52] U.S. Cl. ..... 72/62; 72/342.7; 72/342.97; 29/421.1

[58] Field of Search ..... 72/58, 61, 62, 72/342.7, 342.94, 342.96

[56] References Cited

U.S. PATENT DOCUMENTS

| | | | |
|---|---|---|---|
| 1,000,574 | 8/1911 | Bauroth . | |
| 1,926,353 | 9/1933 | Spatta . | |
| 2,203,868 | 6/1940 | Gray et al. . | |
| 2,205,893 | 6/1940 | Unger . | |
| 3,273,916 | 9/1966 | Tillery . | |
| 3,358,489 | 12/1967 | Hutchins . | |
| 3,564,886 | 2/1971 | Nakamura . | |
| 3,583,188 | 6/1971 | Nakamura . | |
| 3,672,194 | 6/1972 | Martin . | |
| 3,685,327 | 8/1972 | Nakamura . | |
| 3,798,943 | 3/1974 | Benteler et al. . | |
| 3,914,969 | 10/1975 | Banks . | |
| 4,237,713 | 12/1980 | Benteler et al. . | |
| 4,267,718 | 5/1981 | Benteler et al. . | |
| 4,319,471 | 3/1982 | Benteler et al. . | |
| 4,354,369 | 10/1982 | Hamilton . | |
| 4,437,326 | 3/1984 | Carson et al. | 72/62 |
| 4,567,743 | 2/1986 | Cudini . | |
| 4,619,129 | 10/1986 | Petkov et al. . | |
| 4,751,835 | 6/1988 | Galaniuk et al. . | |

(List continued on next page.)

FOREIGN PATENT DOCUMENTS

| | | | |
|---|---|---|---|
| 1055236 | 5/1979 | Canada . | |
| 0-036-365 | 3/1981 | European Pat. Off. . | |
| 0-588-528-A1 | 3/1994 | European Pat. Off. . | |
| 0-686-440-A1 | 12/1995 | European Pat. Off. . | |
| 610114 | 3/1935 | Germany . | |
| 37-9318 | 7/1962 | Japan | 72/61 |
| 38-19434 | 9/1963 | Japan | 72/58 |
| 44-21969 | 9/1969 | Japan | 72/62 |
| 56-17132 | 2/1981 | Japan | 72/62 |
| 61-49735 | 3/1986 | Japan | 72/61 |
| 385146 | 3/1965 | Switzerland . | |

OTHER PUBLICATIONS

Dohmann/Klass, "Methods of Tube Forming", *Strips Sheets Tubes*, (Mar. 1986), pp. 39–41.

Sawyer, Christopher A., "Hydro–Forming is Hot", *Automotive Industries*, (Jun., 1991), pp. 49, 51.

Mason, Murray, "Hydroform Tubes for Automotive Body Structure Applications", *SAE Technical Paper Series*, Series No. 930575, (May, 1993), pp. 59–64.

Pennington, J. Neiland, "Hydroforming: More part for less cost in GM luxury/performance cars", *Modern Metals*, (Oct., 1994), pp. 36, 38, 40–41.

"Hyprotec Delivery to North America Completed", *Hyprotec—News*, (1995), pp. 1–4.

"The Modular IHP Plant System", *H & B Hyprotec Technologie oHG*, (Jan., 1995).

Christensen, William L., "Hydroforming of Tubular Sections", *MetalForming*, (Oct., 1995), pp. 36–38, 40, 43.

*Primary Examiner*—David Jones
*Attorney, Agent, or Firm*—Harness, Dickey & Pierce, P.L.C.

[57] ABSTRACT

A forming device including discreet heating zones along the axial length and circumferential portion of a mold cavity. One zone can be heated to cause the heated tube portion to become more elastic than the non-heated tube portions. As a result, less axial force and radial pressures are required in order to provide the necessary metal deformation against the mold halves. Preferably, the heating zones are provided by way of a series of induction coils disposed along the axial length and circumferential portion of the tube. Each induction coil can be individually energized so that select portions of the tube are heated in a controlled manner.

17 Claims, 3 Drawing Sheets

U.S. PATENT DOCUMENTS 4,761,982 8/1988 Snyder .
4,763,503 8/1988 Hughes et al. .
4,901,552 2/1990 Ginty et al. .
4,936,128 6/1990 Story et al. .
4,951,492 8/1990 Vogt .
5,107,693 4/1992 Olszewski et al. .
5,157,969 10/1992 Roper .
5,170,557 12/1992 Rigsby .
5,233,854 8/1993 Bowman et al. .
5,233,856 8/1993 Shimanovski et al. .
5,239,852 8/1993 Roper .
5,279,142 1/1994 Kaiser .
5,303,570 4/1994 Kaiser .
5,321,964 6/1994 Shimanovski et al. ..... 72/62
5,333,775 8/1994 Bruggemann et al. .
5,339,667 8/1994 Shah et al. .
5,353,618 10/1994 Roper et al. .
5,363,544 11/1994 Wells et al. .
5,372,026 12/1994 Roper .
5,372,027 12/1994 Roper et al. .
5,398,533 3/1995 Shimanovski et al. .
5,415,021 5/1995 Folmer .
5,419,791 5/1995 Folmer .
5,445,001 8/1995 Snavely .
5,460,026 10/1995 Schäfer .
5,471,857 12/1995 Dickerson .
5,475,911 12/1995 Wells et al. .
5,481,892 1/1996 Roper et al. ..... 72/62
5,553,474 9/1996 Nokajima et al. ..... 72/342.7

FORMING TECHNIQUE USING DISCRETE HEATING ZONES

BACKGROUND OF THE INVENTION

FIELD OF THE INVENTION

The present invention relates to an apparatus and method for shaping a hollow body. More particularly, the present invention relates to a forming technique using a high pressure fluid and discreet heating zones.

BACKGROUND AND SUMMARY OF THE INVENTION

Hydroforming is typically used for the forming of a metallic component in a closed dye using internal hydraulic pressure to create a change in form of the metallic component. Hydroforming is primarily applied to forming of hollow bodies such as tubular members. Using a hydroforming technique, tubular members can be provided with unique shapes while maintaining the structural strength of the tube. In known hydroforming processes a metal tube is placed between two mold halves having inner surfaces which define the desired ultimate shape of the part. High pressure fluid, such as water, is introduced into the interior of the tube. The high pressure fluid forces the walls of the tube to expand against the irregular mold surfaces. In order to insure that the wall thickness of the tube is uniform, an axial force is also applied to opposite ends of the tube. The axial forces feed material into the deformation zone. These axial forces can become large since friction exists between the expanded tube and the mold. Extremely high pressure is required in order to accomplish satisfactory and uniform metal deformation against the mold halves. The prior art hydroforming machines are, thus, relatively complex and expensive to produce.

The present invention provides an apparatus and method for providing discreet heating zones along the axial length of the forming mold or located discretely around the circumference of the tube. One zone can be heated to cause the heated tube portion within the zone to become more elastic than the non-heated tube portions. As a result, reduced axial and radial pressures are required in order to provide the necessary metal deformation against the mold halves. Preferably, the heating zones are provided by way of a series of induction coils disposed along the axial length of the tube or discretely located around the circumference of the tube. Each induction coil can be individually energized so that select portions of the tube are heated in a controlled manner. Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
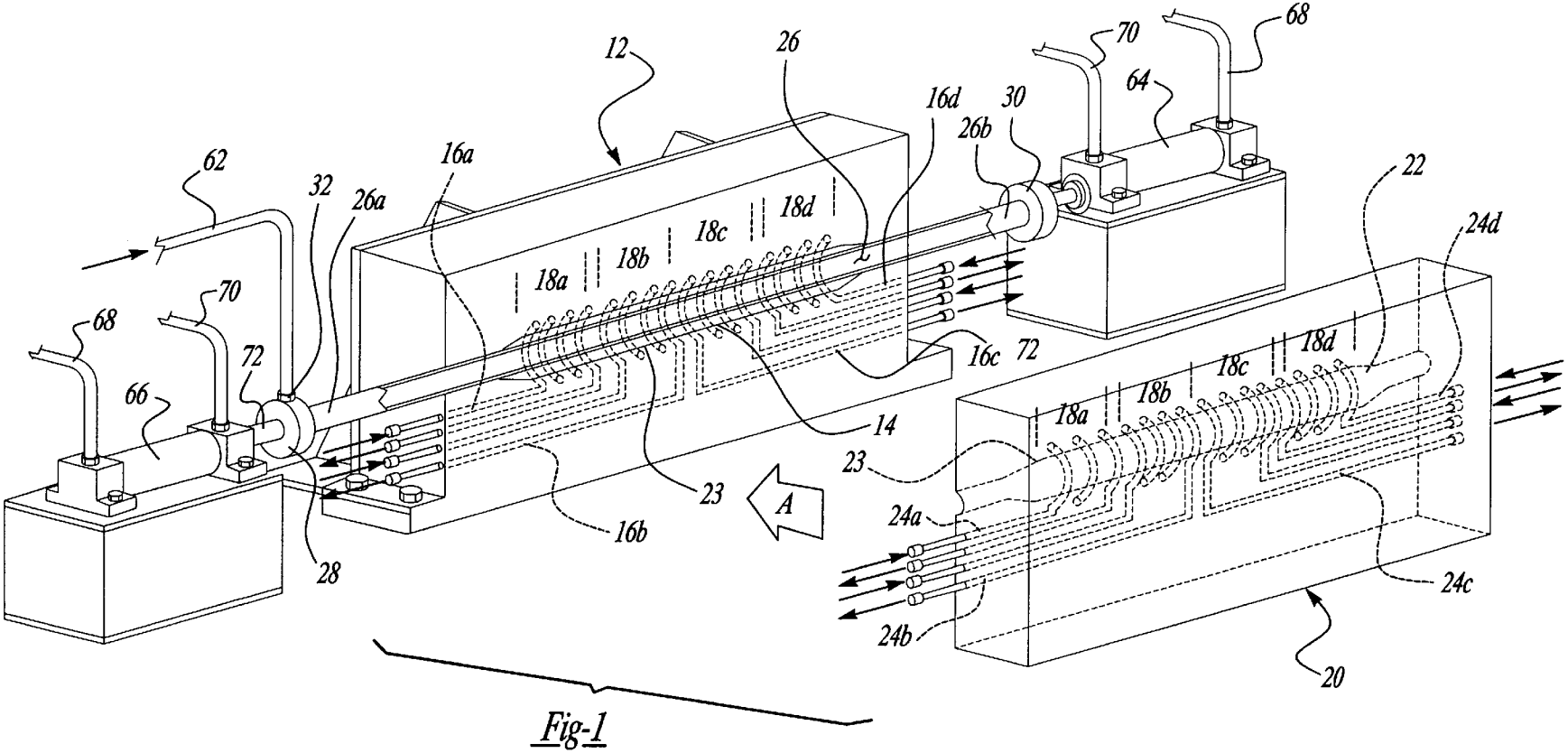
FIG. 1 is a perspective view of a forming apparatus according to the principles of the present invention.
Figure 2:
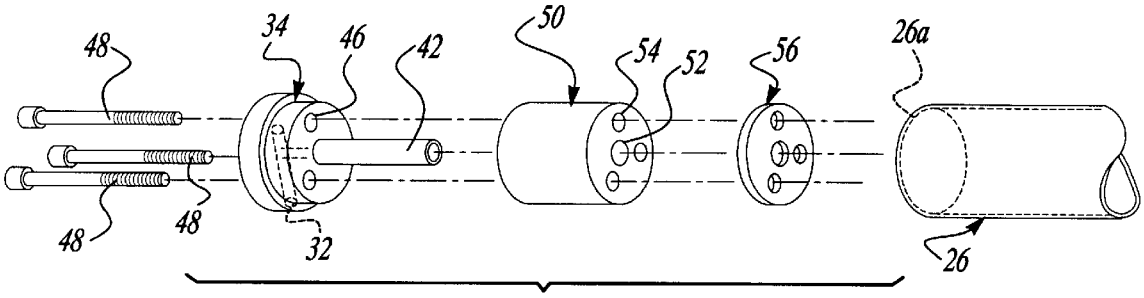
FIG. 2 is an exploded perspective view of an end cap seal assembly having an inlet port for supplying pressurized gas to the tube.
Figure 3:
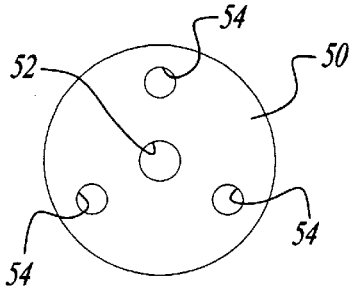
FIG. 3 is an end view of a plug for use in the end cap seal assembly according to the present invention.
Figure 4:
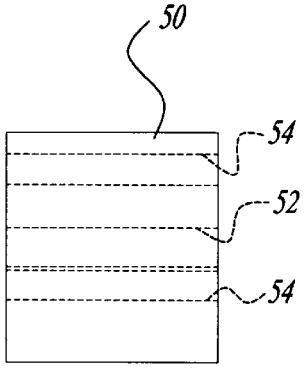
FIG. 4 is a side view of the plug shown in FIG. 3.
Figure 5:
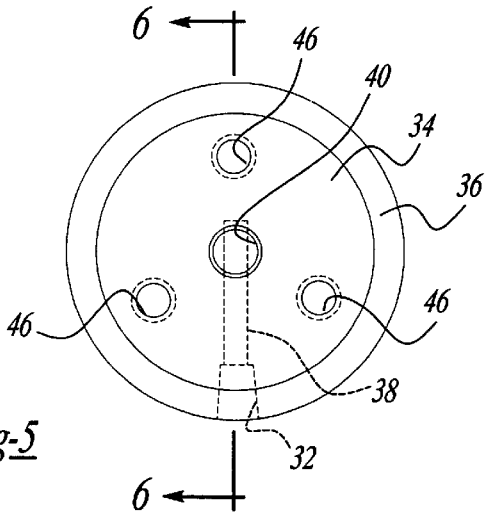
FIG. 5 is an end view of an end cap according to the principles of the present invention.
Figure 6:
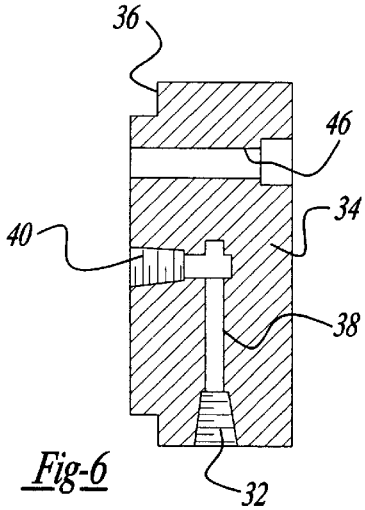
FIG. 6 is a cross-sectional view taken along line 6—6 of FIG. 5.
Figure 7:
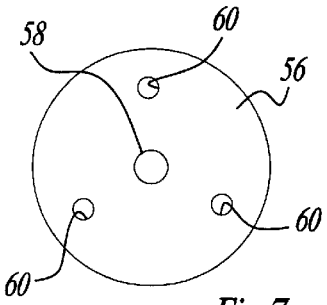
FIG. 7 is an end view of a plate used with the end cap seal of the present invention.
Figure 8:
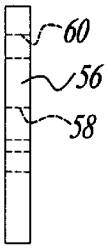
FIG. 8 is a side view of the plate shown in FIG. 7.
Figure 9:
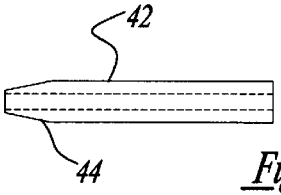
FIG. 9 is a side view of a pipe nipple of the end cap seal assembly according to the present invention.

With reference to the accompanying figures, the forming apparatus of the present invention will be described. The forming apparatus 10 includes a stationary mold portion 12 having a first mold cavity portion 14 disposed therein. A plurality of multi-turn solenoid inductor coils 16*a*–16*d* are provided for defining discreet heating zones 18*a*–18*d*, respectively. A second movable mold portion 20 is provided for mating with the stationary mold portion 12. Movable mold portion 20 includes a second mold cavity portion 22. First and second mold cavity portions 14, 22 combine to define mold cavity 23. A plurality of multi-turn solenoidal inductor coils 24*a*–24*d* are provided around the mold cavity portion 22 for defining discreet heating zones 18*a*–18*d*, respectively. Inductor coils 16*a*–16*d*, 24*a*–24*d* include inlet and outlet connectors for electrical connection to a controlled power source. The controlled power source provides controlled heating of each discreet heating zone 18*a*–18*d* as desired during the forming process. The inductor coils 16*a*–16*d* can be cooled by a fluid.

A hollow member 26 is supported within mold cavity 23 and is supported at its ends by first and second seal assemblies 28, 30, respectively. Hollow member 26 can have a variety of cross sectional shapes including round, square, and rectangular. With reference to FIGS. 2–9, the seal assemblies 28, 30 will be described in greater detail. First seal assembly 28 is provided with an inlet port 32 which is disposed in an end cap 34. End cap 34 is provided with a shoulder portion 36 which is received in an end 26*a* of hollow member 26. Inlet port 32 is connected to an internal passage 38. Internal passage 38 is connected to a centrally located tapered bore 40. A pipe nipple 42 is provided with a tapered end 44 which is received in bore 40 of end cap 34. End cap 34 is provided with a plurality of through holes 46 for receiving screws 48 therethrough. End cap 34 can be made of a rigid material such as aluminum or steel.

A plug 50 is disposed next to end cap 34. Plug 50 is provided with a central opening 52 for receiving pipe nipple 42 therethrough. A plurality of thru holes 54 are provided corresponding to thru holes 46 of end cap 34. Plug 50 is preferably made of an elastomeric material such as silicone.

A plate 56 is provided adjacent to plug 50. Plate 56 is preferably made of a rigid material such as steel. A central opening 58 is provided in the plate 56 for receiving pipe nipple 42. A plurality of threaded openings 60 are provided for receiving the threaded ends of screws 48.

During operation, screws 48 are inserted through openings 46 of end cap 34 and openings 54 of plug 50. The screws are threadedly engaged with the threaded openings 60 of plate 56. The seal assemblies 28, 30 are inserted into the ends 26*a* and 26*b* of hollow member 26 so that the hollow member 26 abuts against the shoulder 36 of end cap 34. Screws 48 can be tightened in order to compress plug 50 in order to obtain a sealed connection with hollow member 26. Pressurized fluid such as nitrogen gas is provided through inlet port 32 via supply line 62. It should be noted that seal assembly 30 is not provided with an inlet port.

A pair of hydraulic cylinders 64, 66 are provided at opposite ends of the stationary mold 12 and movable mold 20. Hydraulic cylinders 64, 66 are each provided with a piston (not shown) disposed within each cylinder and a pair of hydraulic supply lines 68, 70 disposed at opposite ends of the cylinders. Pressurized fluid is provided to the supply lines 68 in order to provide a force against the pistons which in turn provide an axial force on the piston shafts 72. The piston shafts 72 are connected to the end cap seal assemblies 28, 30. Thus, delivery of pressurized fluid to supply lines 68 provide an axial compression force on the tubular member 26. Providing hydraulic fluid to supply lines 70 will cause the piston of the hydraulic cylinders 64, 66 to release the axial pressure on the tubular member 26.

In operation, a tubular member 26 is disposed between stationary mold 12 and movable mold 20. Movable mold 20 is moved in the direction of arrow "A" in order to close the mold which defines mold cavity 23. First and second seal assemblies 28, 30 are inserted into the ends of tube 26. A pressurized fluid such as nitrogen gas is provided through line 62 into inlet port 32 of end cap seal assembly 28. In addition, hydraulic cylinders 64, 66 are actuated to provided an axial compression force on the ends of tube 26. Furthermore, inductor coils 16*a*–16*d* and 24*a*–24*d* are selectively activated in order to provide heat to discreet heating zones 18*a*–18*d* of mold halves 12 and 20. In such manner, one zone can be heated to cause the heated tube portion to become more elastic than the non-heated tube portions. As a result, less radial pressure is required in order to provide the necessary metal deformation against the mold halves 12, 20. Also less axial force is required not only due to the local increased elasticity of the tube but also because the unheated portion of the tube has not been expanded to create a friction resistance between the mold surface and the tube. By not expanding the entire tube at once, greater flexibility in terms of product design is possible. In particular, it is easier to feed material to the expanding portion of the hollow member if the rest of the tube is not "locked up" against the mold surface.

Figure 10A:
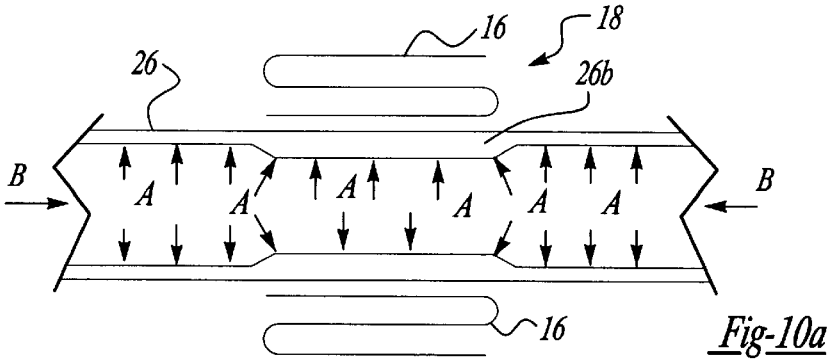
FIG. 10*a* is a side view illustrating a step in a process according to the teachings of the present invention.
Figure 10B:
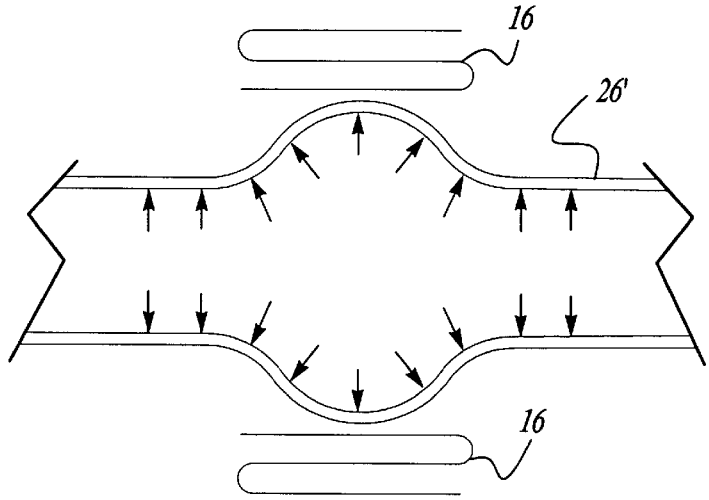
FIG. 10*b* is a side view of a subsequent step of the process.
Figure 11A:
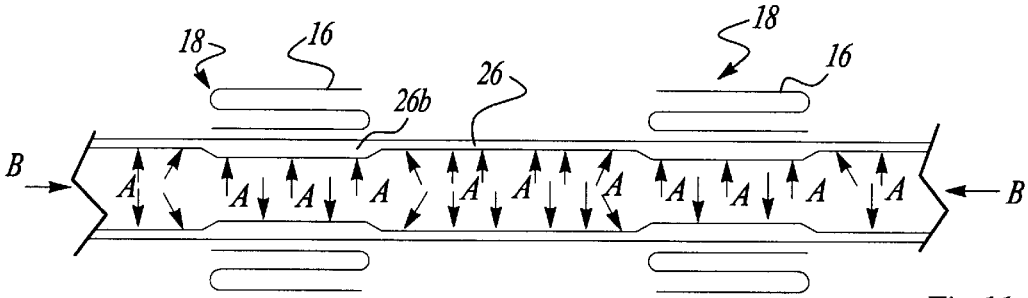
FIG. 11*a* is a side view similar to FIG. 10*a*.
Figure 11B:
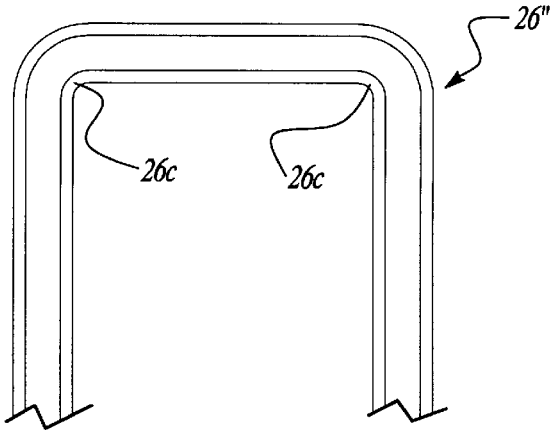
FIG. 11*b* illustrates a final part made by the process.

With reference to FIGS. 10*a*–10*b* and 11*a*–11*b* a process is illustrated wherein the induction coils 16 are utilized in a preliminary step to increase the wall thickness of a tubular member 26 in a local region 26*b*. The increased wall thickness is obtained by heating the induction coils 16 while applying an internal fluid pressure (represented by arrows A) and an end feeding force (represented by arrows B) to each of the ends of the tubular member 26. The heating of the tubular member 26 in the area of the heating zone 18 causes the tubular member 26 to become most deformable in that region. Thus, areas 26*b* of increased wall thickness are created, as shown in FIGS. 10*a* and 11*a*. Once the wall thickness is increased, the tubular member 26 can be formed into a final desired configuration 26' using a hydroforming process, as shown in FIG. 10*a*, either with or without the discrete heating zones. The increased wall thickness obtained in the preliminary step (FIGS. 10*a* and 11*a*) allow the walls to be strategically deformed to maintain a near constant wall thickness after the tubular members 26 are in their final configuration. With reference to FIGS. 11*a*–11*b*, the added thickness obtained in a preliminary discrete heating process allows the tubular member 26 to be bent into a final configuration 26" without the concern that the wall thickness will become to thin in the area of the bends 26*c*.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for forming hollow members comprising:

a first mold portion;

a second mold portion movable relative to said first mold portion, said first and second mold portions defining a mold cavity;

a plurality of heating members disposed in said first and second mold portions; and a control device operatively connected to said plurality of heating members for selectively activating said plurality of heating members to provide a plurality of discrete heating zones within said mold cavity.

2. The forming apparatus according to claim 1, wherein said heating members include inductor coils.

3. The forming apparatus according to claim 1, further comprising means for applying an axial force to the ends of a hollow member.

4. The forming apparatus according to claim 3, wherein said means for applying an axial force to the ends of a hollow member include first and second hydraulic cylinders disposed at opposite ends of said first and second mold portions.

5. The forming apparatus according to claim 1, further comprising first and second end caps for supporting first and second ends of a hollow member, one of said first and second end caps including an inlet port for receiving a forming medium.

6. The forming apparatus according to claim 3, further comprising first and second end caps for supporting first and second ends of a hollow member, one of said first and second end caps including an inlet port for receiving a pressurized medium.

7. The forming apparatus according to claim 6, wherein said means for applying an axial force to the ends of a hollow member is actuated while said pressurized medium is supplied to said inlet port and at least one of said heating coils is heated.

8. The forming apparatus according to claim 5, wherein said pressurized medium is a gas.

9. A method of forming a hollow member comprising the steps of:

supporting said hollow member in a mold cavity;

supplying a pressurized medium inside of said hollow member;

heating a first discrete portion of said mold cavity beginning at a first time; and heating a second discrete portion of said mold cavity beginning at a second time after said first time.

10. The method according to claim 9, further comprising the step of applying an axial force to the ends of said hollow member.

11. The method according to claim 10, wherein a first inductor coil is provided for heating said first discrete portion of said mold cavity.

12. The method according to claim 11, wherein a second inductor coil is provided for heating said second discrete portion of said mold cavity.

13. A method of forming a hollow member comprising the steps of:

supporting said hollow member in a mold cavity;

supplying a pressurized medium inside of said hollow member;

heating a discrete portion of said mold cavity during said step of supplying a pressurized medium; and applying an axial force to at least one end of said hollow member.

14. The method according to claim 13, wherein said step of applying an axial force to at least one end of said hollow member causes a wall thickness of said tubular member to increase in a location corresponding to said discrete portion of said mold cavity.

15. The method according to claim 14, further comprising the step of further deforming said tubular member in a location where said wall thickness has been increased.

16. The method according to claim 15, wherein said step of further deforming said tubular member includes bending said tubular member.

17. The method according to claim 15, wherein said step of further deforming said tubular member includes the steps of inserting said tubular member in a second mold cavity, supplying a pressurized medium inside of said hollow member, and heating a discrete portion of said mold cavity corresponding to said location where said wall thickness has been increased.

* * * * *